United States Patent [19]

Birckhead et al.

[11] 4,442,649

[45] Apr. 17, 1984

[54] FABRICATED BEAM

[76] Inventors: Robert Birckhead, 3127 SW. Natura Ave., Deerfield Beach, Fla. 33441; William R. McAlpine, 9451 NW. 40th St., Coral Springs, Fla. 33065

[21] Appl. No.: 434,962

[22] Filed: Oct. 18, 1982

[51] Int. Cl.[3] ..... E04C 3/02; E04H 12/06

[52] U.S. Cl. ..... 52/693; 52/DIG. 6; 403/283

[58] Field of Search ..... 403/283; 52/693, DIG. 6, 52/696

[56] References Cited

U.S. PATENT DOCUMENTS

| | | | |
|---|---|---|---|
| 493,882 | 3/1893 | White | 52/DIG. 6 |
| 1,449,721 | 3/1923 | Arnstein | 52/695 |
| 2,302,101 | 11/1942 | Boydstun | 52/657 |
| 2,363,568 | 11/1944 | Butler | 52/729 |
| 2,868,146 | 1/1959 | Mackintosh | 52/639 |
| 2,877,520 | 3/1959 | Jureit | 52/DIG. 6 |
| 4,040,232 | 8/1977 | Snow et al. | 52/693 |

FOREIGN PATENT DOCUMENTS

| | | | |
|---|---|---|---|
| 643612 | 6/1962 | Canada | 403/405 |

*Primary Examiner*—James L. Ridgill, Jr.
*Attorney, Agent, or Firm*—Malin, Haley & McHale

[57] ABSTRACT

A fabricated wooden beam including at least two longitudinal wooden members spaced parallel and apart by a plurality of wooden blocks spaced between and along the length of the longitudinal members. A plurality of truss plates, each installed across one side of a block and spanning between each longitudinal member, provide structural integrity. The truss plates are installed in pairs with one across either face of each block at an acute angle to the longitudinal axis of the beam. Alignment of the generally parallel truss plates on one side of the beam is at an acute or preferably right angle to the alignment of the generally parallel truss plates on the opposite side of the beam. The preferred truss plate alignment of truss plates on both sides of the beam is at approximately 45° to the longitudinal axis of the beam so that the beam has structural symmetry and optimal material utilization. Narrow truss plates at each end, tieing the ends of the longitudinal members and the end block more securely together, are designer optional.

6 Claims, 5 Drawing Figures

FABRICATED BEAM

BACKGROUND OF THE INVENTION

This invention relates generally to beams for construction and more particularly to fabricated wooden beams.

As first-generation forests are used up and replanted, the second-generation trees do not increase in trunk diameter uniformly with time. These second-generation trees grow relatively quickly to a certain trunk diameter and beyond that size, growth is slower. Therefore, the optimum growing time before harvest produces narrower timber for use in fashioning beams, stringers or the like. Prior art discloses certain methods of mechanically fastening two or more continuous narrower beams together to form a single wider beam of the desired width previously readily available from first-generation timber. One such method, employed by Simplex Development Corporation in their KOR-JOIST, is a plurality of closely-spaced unique fasteners driven into both sides of the beam parallel to one another and at an acute angle to the seam to span the joint or seam between any two longitudinal members. Only full-length longitudinal members are generally used, and where beam width requirements exceed a certain amount, three or more full-length members are so joined together.

Another method of beam fabrication is used by Automated Construction Equipment, Inc., in their W-JOIST. This fabricated beam design eliminates a significant portion of the length of the center longitudinal member in a three-member beam. In place of the eliminated center member portions are one or more unique "W"-shaped truss plates driven into both ends of the outer members. However, these "W"-shaped truss plates are expensive and, additionally, beams constructed thusly may only be varied in length a certain amount by cutting. No cuts may be made through the expanse of abutting "W"-shaped truss plates. Additionally, the portions of the center member which are required are of sufficient length so as to represent a significant portion of the overall wood material cost and must also be truss plated or stapled to the outer members by means separate from the "W" truss plates.

The present invention discloses a fabricated wooden beam constructed of two or more full-length members spaced apart to achieve the desired overall beam width by short spacer blocks of typically otherwise scrap wood. These pieces are held together in a secure useful beam or stringer by a plurality of conventional truss plates nailed or pressed into place, one diagonally across each spacer block and into the longitudinal members which the spacer block is separating. These truss plates are so placed in pairs, one on each side of the beam, such that the parallel diagonal alignment of the truss plates on one side of the beam crosses those placed on the opposite side of the beam. As the larger one-piece beams are depleted in the forests, these wider fabricated beams will become less expensive in both material cost and in manufacturing labor costs and afford versitility in available cutting lengths.

BRIEF DESCRIPTION OF THE INVENTION

A fabricated wooden beam including at least two longitudinal wooden members spaced parallel and apart by a plurality of wooden blocks spaced between and along the length of the longitudinal members. A plurality of truss plates, each installed across one side of a block and spanning between each longitudinal member, provide structural stability. The truss plates are installed in pairs across each face of each block at an acute angle to the longitudinal axis of the beam. Alignment of the generally parallel truss plates on one side of the beam is at an acute or preferably right angle to the alignment of the generally parallel truss plates on the opposite side of the beam. The preferred truss plate alignment of truss plates on both sides of the beam is at approximately 45° to the longitudinal axis of the beam so that the beam has structural symmetry and optimal strength/cost benefits. Narrow truss plates at the ends tieing the ends of the longitudinal members and the end block more securely together are designer optional.

The blocks are typically fabricated of scrap end portions cut from other longitudinal members and need not have square-cut ends but only parallel edge surfaces, and need not be longer than sufficient to fully receive the penetrating nail portions or teeth formed as part of the truss plates, or very close thereto, so as not to destroy the structural shear integrity of the plate.

It is an object of this invention to provide a low-cost fabricated wooden beam of large width to replace wide one-piece beams.

It is another object of this invention to provide a wide fabricated wooden beam as above which replaces one of the full-length members with a plurality of short, usually scrap spacer blocks, all securely fastened together with conventional truss plates.

It is still another object of this invention to provide the above fabricated wooden beam which may be cut in various lengths at the job site and/or easily fabricated in incremental lengths.

It is yet another object of this invention to provide a fabricated beam which has symmetric strength characteristics.

And still another object of this invention is to provide a fabricated wooden beam with optimal strength-to-cost benefits.

In accordance with these and other objects which will be apparent hereinafter, the instant invention will now be described with particular reference to the accompanying drawings.

PREFERRED EMBODIMENT OF THE INVENTION

Figure 1:
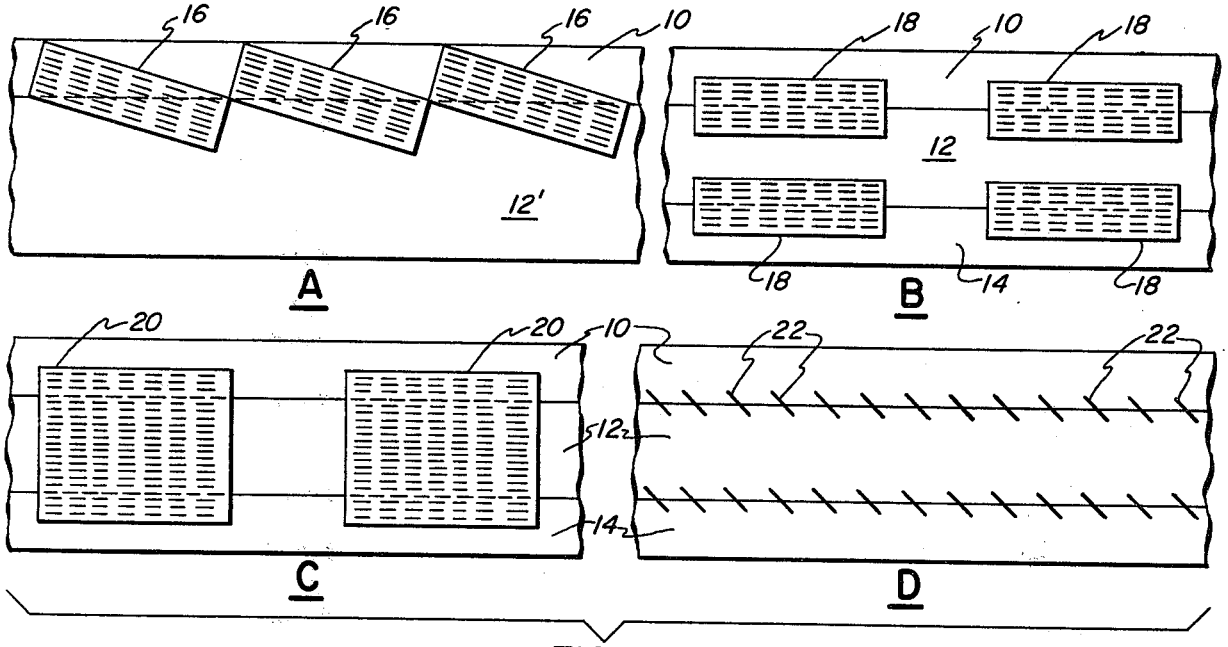
FIG. 1 (PRIOR ART)
FIG. 1 is a front elevation view of a composite of prior art fabricated beams.
Figure 2:
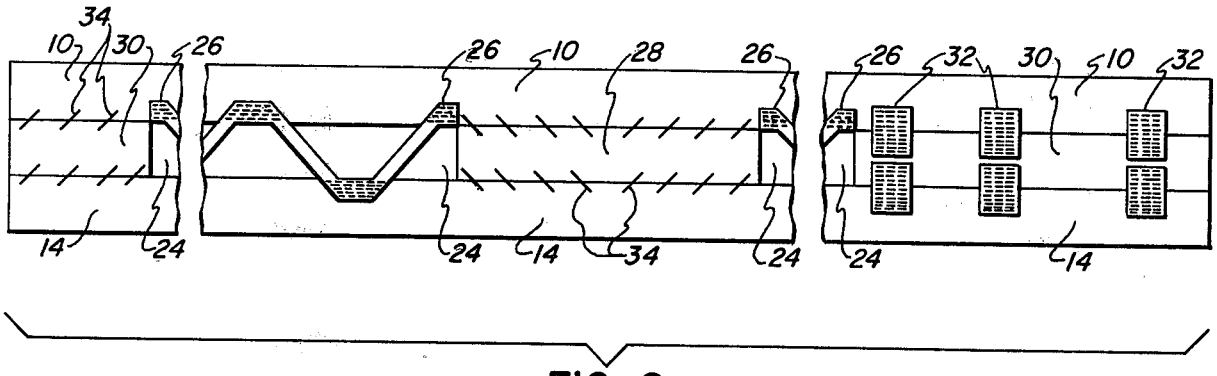
FIG. 2 (PRIOR ART)
FIG. 2 is a front elevation view of one additional prior art fabricated beam.

Referring now to the drawings, and particularly to FIGS. 1 and 2, prior art known to the applicant is therein shown. FIG. 1 presents, along one composite fabricated beam 10, the various mechanical means known to applicant for interconnection of two or more longitudinal members 10, 12 or 12', and 14. All of this prior art in FIG. 1 incorporates all full-length members, except in cases where the center member is sometimes not full-length, leaving a gap near the longitudinal center. At A, the members are joined by a plurality of truss plates 16 having formed nails or teeth generally perpendicular to the plane of the truss plate. These truss plates are hammered or pressed into each adjacent member 10 and 12' spanning the joint therebetween and at a slight angle to the longitudinal axis of the beam as shown. An equivalent number of truss plates are installed on the opposite side of the beam at a corresponding crossed angle to those on the side shown. Longitudinally positioned truss plates 18 shown at B have also been used previously to span a single joint while larger truss plates 20 as in C have been employed to span more than one joint nailing into at least a portion of three adjacent longitudinal members 10, 12 and 14. Specially designed KOR-JOIST fasteners 22 by Simplex Development Corporation, shown at D, are driven into two abutted adjacent members at an acute angle to the longitudinal axis of the beam to form the fabricated joint.

FIG. 2 shows a prior art fabricated beam, W-JOIST by Automated Construction Equipment, Inc., including outer longitudinal members 10 and 14. However, the full-length center member has been eliminated and replaced with shorter spacer sections 28 and 30, leaving openings 24 in the beam. These openings 24 are spanned to retain beam strength by unique W-shaped metal webs 26 which nail into both outer beams 10 and 14. The end spacer sections 30 are retained by means similar to that shown in FIG. 1, that being by corrogated metal fasteners 34 or by truss plates 32 spanning and securing the joint. The mid-portion of this prior art fabricated beam incorporates opposingly angled fasteners 34 as shown. This beam design has the disadvantage of high cost and not being able to be cut at various lengths. Only a certain amount may be removed from each end. No cuts are possible through and adjacent the W-shaped metal webs 26.

Figure 3:
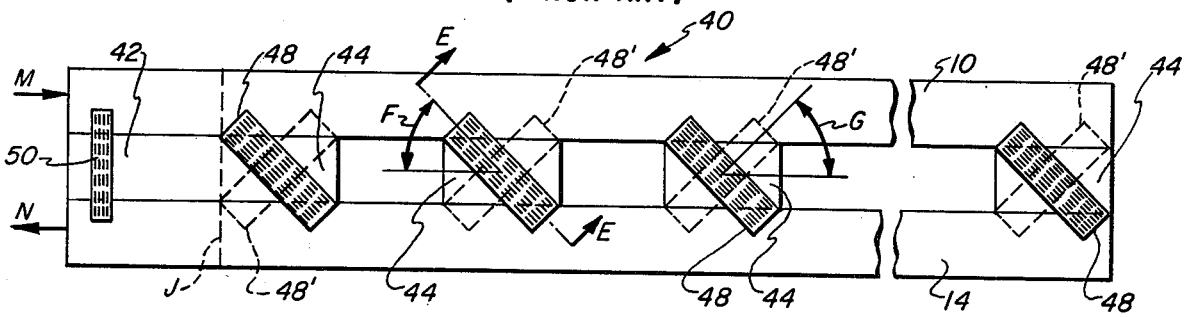
FIG. 3 is a front elevation view of the present invention.
Figure 4:
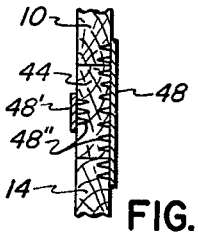
FIG. 4 is a partial sectional view through E—E in FIG. 3.
Figure 5:
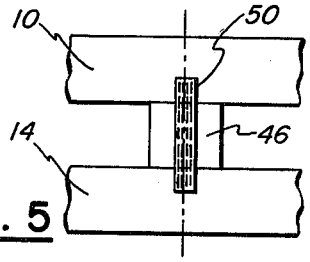
FIG. 5 is a partial front elevation view of the center section of one embodiment of the present invention.

Referring now to FIGS. 3, 4, and 5, the present invention is shown generally at 40 and includes parallel longitudinal wooden members 10 and 14, a plurality of very short spacer blocks 44 and a plurality of truss plates 48 on the front face of the beam as shown and a similar number of the same design truss plates 48' on the opposite face of the beam. The truss plates 48 are aligned generally parallel to one another and at an angle F to the longitudinal axis of the beam. Truss plates 48' are aligned generally at an angle G to the longitudinal axis of the beam, the angle G substantially equal to angle F, both E and F preferably approximately 45° angles. The end spacer block may be made longer than the intermediate spacer blocks 44 as shown by numeral 42, in which case an additional narrower truss plate 50 may be required for additional strength. These spacer blocks 44 are shown having square-cut ends but need not be specially prepared thusly. Scrap blocks having non-parallel end cuts, but only having parallel edge surfaces matable against the edges of the longitudinal members 10 and 14, are all that are required.

FIG. 4 is a sectional view through E—E in FIG. 3 and shows that the formed nails 48'' of the truss plates 48 and 48' penetrate both longitudinal members 10 and 14 as well as the spacer block 44.

Referring to FIG. 5, when there are odd numbers of spacer blocks, the center spacer block 46 may be shorter and be retained by narrower truss plates 50 and may also be used on longer end spacer blocks 42 in FIG. 3.

Referring again to FIG. 3, this fabricated beam 40 includes truss plate pairs having truss plates 48 and 48' on opposite faces of the beam which align at an acute or preferably right angle to one another, truss plates 48 parallel to one another, and truss plates 48' parallel to one another so that when vertical bending loads produce compression force M and tension force N about the neutral longitudinal axis of the beam as installed, the truss plates 48 on the front face of the beam in the left half are in compression-shear while those truss plates 48' on the opposite face of the beam in the left half are in tension-shear.

The fabricated beam 40 may be cut any place up to twelve inches from either or both ends along the beam as at J, but not through the truss plates. These beams may also be initially fabricated in two-foot increments providing a full range of lengths to match or exceed the large one-piece beams. Shorter beams experience less bending stress in use and therefore longitudinal member strength is reduced along with reduced tension or compression/shear loading on the truss plates. Optimal truss plate orientation for minimizing and balancing truss plate forces is at approximately 45° to the longitudinal axis of the beam. An important further benefit of the instant invention is that, because the spacer blocks are relatively short in length, scrap pieces of timber, offal from previously cut timber may, instead of being discarded, and preferably, be used as spacer blocks in the fabrication of this beam. These scrap blocks 44 are shown having square end-cut surfaces, but need not be trimmed especially so. Any scrap pieces, regardless of whether the ends are cut square or on an angle, may be used as is. The cost savings, as opposed to cutting longer sections from full-length members, is substantial while achieving superior structural strength and stability.

The instant invention has been shown and described herein in what is considered to be the most practical and preferred embodiment. It is recognized, however, that departures may be made therefrom within the scope of the invention and that obvious modifications may occur to a person skilled in the art.

What I claim is:

1. A fabricated beam for use in building construction or the like, said beam comprising:

at least two longitudinal wooden members generally parallel and spaced apart from one another;

a plurality of wooden spacer blocks, each spacer block of said plurality of said spacer blocks positioned between and along the length of said at least two longitudinal wooden members;

a plurality of pairs of metal truss plates formed from sheet metal stock and having formed nail portions extending perpendicularly from one side of the plane of said truss plates;

each of said pair of truss plate nail portions forcibly urged into two adjacent said at least two longitudinal members and into a different said spacer block;

the longitudinal axes of each truss plate of each said pair of truss plates intersecting over a said different spacer block into which said pair of truss plate nail portions is said forcibly urged;

said longitudinal axes of each truss plate of said pair of truss plates forming an acute angle with the longitudinal axis of said beam.

2. A fabricated beam as set forth in claim 1, further comprising:

two additional pairs of narrow truss plates formed from sheet metal stock and having formed nail portions extending perpendicularly from one side of the plane of said two additional pairs of truss plates;

each of said pair of narrow truss plate nail portions forcibly urged into said at least two longitudinal members and into an end said spacer block;

the longitudinal axes of each truss plate of each said pair of narrow truss plates parallel and perpendicular to said longitudinal axes of said beam.

3. A fabricated beam as set forth in claim 1, wherein: the strength of said longitudinal members and the strength and thickness of said truss plates are selected in relation to the overall length of said beam.

4. A fabricated beam as set forth in claim 1, wherein: said acute angle is selected to maximize the combination of tension/compression and shear forces applied to said truss plates when in-use bending loads are applied to said beam to minimize area and cross-sectional truss plate tooth-holding area and cross-sectional area thereby also minimizing said truss plate cost.

5. A fabricated beam as set forth in claim 4, wherein: said acute angle is approximately 45°.

6. A fabricated beam as set forth in claim 1, wherein: said plurality of spacer blocks are each substantially shorter than said at least two longitudinal members; said plurality of wooden spacer blocks are short scrap portions of wood such as those remaining offals from previously cut lumber.

* * * * *